US009993861B2

(12) United States Patent
Yoon et al.

(10) Patent No.: US 9,993,861 B2
(45) Date of Patent: Jun. 12, 2018

(54) ROLLER HEMMING APPARATUS

(71) Applicant: SUNGWOO HITECH CO., LTD., Busan (KR)

(72) Inventors: Tae Wook Yoon, Busan (KR); Mun Yong Lee, Busan (KR)

(73) Assignee: SUNGWOO HITECH CO., LTD., Busan (KR)

( * ) Notice: Subject to any disclaimer, the term of this patent is extended or adjusted under 35 U.S.C. 154(b) by 686 days.

(21) Appl. No.: 14/585,348

(22) Filed: Dec. 30, 2014

(65) Prior Publication Data

US 2016/0158824 A1 Jun. 9, 2016

(30) Foreign Application Priority Data

Dec. 8, 2014 (KR) ..... 10-2014-0175319

(51) Int. Cl.

| | |
|---|---|
| ***B21D 7/02*** | (2006.01) |
| ***B21D 39/02*** | (2006.01) |
| ***B21D 37/16*** | (2006.01) |
| ***B21D 19/04*** | (2006.01) |
| ***B21D 19/02*** | (2006.01) |

(52) U.S. Cl.

CPC ..... *B21D 39/023* (2013.01); *B21D 19/02* (2013.01); *B21D 19/043* (2013.01); *B21D 37/16* (2013.01); *B21D 39/02* (2013.01)

(58) Field of Classification Search

CPC ..... B21D 39/023; B21D 37/16; B21D 39/02; B21D 19/043; B21D 19/02

USPC ..... 72/214, 128

See application file for complete search history.

(56) References Cited

U.S. PATENT DOCUMENTS

| | | | | |
|---|---|---|---|---|
| 7,290,423 | B2 * | 11/2007 | Carsley | B21D 19/043 72/128 |
| 8,677,796 | B2 * | 3/2014 | Carsley | B21D 19/02 29/243.58 |
| 2013/0062003 | A1 * | 3/2013 | Shulkin | B21D 39/02 156/196 |
| 2016/0158824 | A1 * | 6/2016 | Yoon | B21D 37/16 72/6.1 |

FOREIGN PATENT DOCUMENTS

| | | |
|---|---|---|
| KR | 10-2007-0055263 | 5/2007 |
| KR | 10-2012-0001528 | 1/2012 |
| KR | 10-1309518 | 9/2013 |
| KR | 10-2014-0026799 | 3/2014 |

* cited by examiner

*Primary Examiner* — David B Jones
(74) *Attorney, Agent, or Firm* — Lex IP Meister, PLLC

(57) ABSTRACT

A roller hemming apparatus is disclosed. A roller hemming apparatus for hemming an outer panel with respect to an inner panel according to an exemplary embodiment of the present invention may include a tool body mounted at a front end of an arm of a robot, a pre-hemming roller mounted to a front side of a mounting block, which is disposed at a lower portion of the tool body, through a first mounting bracket, a main hemming roller mounted to a rear side of the mounting block through a second mounting bracket, and at least one heater mounted at a lateral side of the mounting block and configured to heat a flange portion of the outer panel.

18 Claims, 10 Drawing Sheets

ROLLER HEMMING APPARATUS

CROSS-REFERENCE TO RELATED APPLICATION

This application claims priority to and the benefit of Korean Patent Application No. 10-2014-0175319 filed in the Korean Intellectual Property Office on Dec. 8, 2014, the entire contents of which are incorporated herein by reference.

BACKGROUND OF THE INVENTION

(a) Field of the Invention

The present invention relates to a roller hemming apparatus. More particularly, the present invention relates to a roller hemming apparatus configured to hem parts for a vehicle using a robot.

(b) Description of the Related Art

In general, a vehicle is manufactured by numerous assembling processes using tens of thousands of parts.

Particularly, in a first stage of a vehicle manufacturing process, various panels are manufactured using various press apparatuses, and the panels are transported to a vehicle body factory. At the vehicle body factory, the panels are assembled so as to form a vehicle body of a body in white (B.I.W) shape.

After the panels of the vehicle body are formed to have a predetermined shape through various press apparatuses by application of pressure, the panels are cut, drilled, bent, and/or curved using press processes such as trimming, piercing, flanging, hemming, and so on.

A part such as a door, a hood, a trunk lid, or a tailgate of a vehicle may include an inner panel and an outer panel, and the inner panel and the outer panel may be assembled together by the hemming process.

According to a conventional hemming process, after a mold corresponding to a panel is mounted at a press-type device, and the inner panel and the outer panel are inserted in a mold, a press mold is moved downwardly so as to fold an end portion of the outer panel and assemble the panels.

Because an expensive mold having a shape similar to the panels must be manufactured for this process, equipment investment may be very large. In addition, because such a press body is very big, designing the equipment layout in a factory is very difficult.

So as to solve such problems a roller hemming method using a robot is mainly used. According to the roller hemming method, a roller hemming apparatus mounted at a multi-joint arm of the robot is used. For example, the roller hemming apparatus may include a tool body fixed to the multi-joint arm of the robot, and a hemming roller rotatably mounted at the tool body.

During a roller hemming process using the roller hemming apparatus, the inner panel and the outer panel loaded on a jig are clamped, a flange portion of the outer panel is pre-hemmed, a sealer is blown into an inner side of the flange portion, and the flange portion of the outer panel is finally hemmed.

A gap, a height difference, and an external appearance of the part are affected due to the roller hemming process, and thus hemming defects such as insufficiency of a bend degree of the flange portion should be overcome.

Particularly, high strength materials such as magnesium and ultra-high tensile steel have been applied to panels of the vehicle body for improving weight of a vehicle body and collision safety in recent years.

When the flange portion including a high strength portion formed of the high strength materials is hemmed, the hemming defects due to a spring back phenomenon (a phenomenon in which the flange portion tends to return toward its original state from a bent state) and cracks frequently occur.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a roller hemming apparatus having advantages of hemming a flange portion of an outer panel by locally heating the flange portion.

A roller hemming apparatus for hemming an outer panel with respect to an inner panel according to an exemplary embodiment of the present invention may include a tool body mounted at a front end of an arm of a robot; a pre-hemming roller mounted to a front side of a mounting block, which is disposed at a lower portion of the tool body, through a first mounting bracket; a main hemming roller mounted to a rear side of the mounting block through a second mounting bracket; and at least one heater mounted at a lateral side of the mounting block and configured to heat a flange portion of the outer panel.

The pre-hemming roller may be formed in a tapered shape having a cross-sectional diameter which is gradually decreased from a rear side to a front side.

The heater may be configured to generate heat by receiving electric power and blowing a hot wind to the flange portion.

The heater may be mounted through a fixing bracket that is fixedly mounted at the lateral side of the mounting block, and may be configured to be tilted toward the pre-hemming roller and the main hemming roller.

A lower portion of the first mounting bracket may be bent frontward and the pre-hemming roller may be rotatably mounted at the lower portion of the first mounting bracket.

The heater may include an air blowing pipe connected to a compressor through an air supply line and a heating line mounted in the air blower pipe and configured to generate heat by receiving electric power.

The heating line may be formed in a coil shape and may be disposed along a length direction of the air blower pipe.

A temperature sensor, which measures a temperature of the heat and transmits a signal corresponding thereto to a controller, may be mounted in a lower portion of the air blower pipe.

The controller may control an amount of the electric power applied to the heating line and an amount of compressed air supplied from a compressor based on the measured temperature.

A roller hemming apparatus for hemming an outer panel with respect to an inner panel according to an exemplary embodiment of the present invention may include: a tool body mounted at a front end portion of an arm of a robot; a pre-hemming roller mounted to a front side of a mounting block, which is disposed at a lower portion of the tool body, through a first mounting bracket; a main hemming roller mounted to a rear side of the mounting block through a second mounting bracket at least one heater mounted at a lateral side of the mounting block and configured to heat a flange portion of the outer panel; and a mounter configured to mount the heater through a fixing bracket that is fixedly mounted at the lateral side of the mounting block and change a position of the heater.

The heater may include an air blower pipe connected to a compressor through an air supply line, and a heating line mounted in the air blower pipe and configured to generate heat by receiving electric power.

A cap connected to the air supply line may be mounted to an upper portion of the air blower pipe, and a hot wind may be blown through a lower portion of the air blower pipe.

A temperature sensor, which measures a temperature of the hot wind and transmits a signal corresponding thereto to a controller, may be mounted in the lower portion of the air blower pipe.

The heating line may be formed in a coil shape and may be disposed along a length direction of the air blower pipe.

The mounter may include: a first link coupled to the fixing bracket; a second link coupled to the first link; and a fixer coupled to the second link and configured to fix the air blower pipe.

The fixer may be formed for surrounding an external circumference of the air blower pipe, and the air blower pipe may be fixed through a fixing ring.

The fixing ring may be fitted to the external circumference of the air blower pipe and may be coupled to the fixer using a bolt.

The lower portion of the air blower pipe may be tilted toward the pre-hemming roller and the main hemming roller using the bolt as a shaft.

A guide slot may be formed in the second link in a length direction the second link.

The pre-hemming roller may be formed in a tapered shape having a cross-sectional diameter which is gradually decreased from a rear side to a front side, a lower portion of the first mounting bracket may be bent frontward, and the pre-hemming roller may be rotatably mounted at the lower portion of the first mounting bracket.

According to an exemplary embodiment of the present invention, the roller hemming apparatus can blow the hot wind to high strength portions of the panels through the heater, and thus the flange portion is softened by the hot wind while the flange portion is hemmed.

In addition, spring back and cracks can be prevented from being generated in the flange portion by heating the flange portion. As a result, it is possible to suppress occurrence of hemming defects such as insufficiency of a bend degree of the flange portion, thereby improving quality of the hemmed part.

BRIEF DESCRIPTION OF THE DRAWINGS

The drawings are provided for reference in describing exemplary embodiments of the present invention, and the spirit of the present invention should not be construed only by the accompanying drawings.

Figure 1:
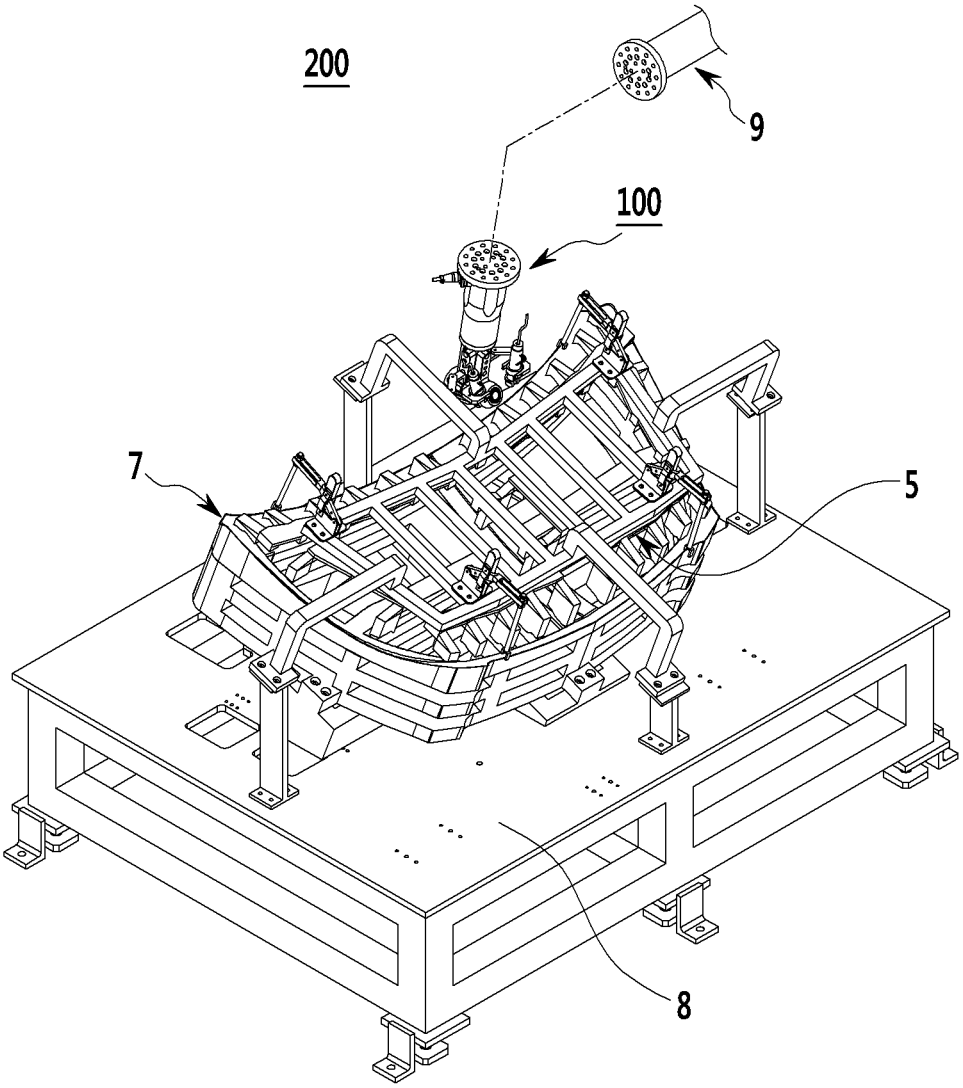
FIG. 1 is a schematic diagram of a part assembling system to which a roller hemming apparatus is applied according to an exemplary embodiment of the present invention.

| <Description of symbols> | |
|---|---|
| 1: outer panel | 1a: flange portion |
| 2: inner panel | 5: clamping pad |
| 7: hemming die | 8: frame |
| 9: robot | 10: tool body |
| 11: mounting block | 31: pre-hemming roller |
| 32: main hemming roller | 35: first mounting bracket |
| 37: second mounting bracket | 50: heater |
| 51: air blower pipe | 52: fixing bracket |
| 53: air supply line | 55: compressor |
| 57: cap | 59: temperature sensor |
| 61: heating line | 63: power supply line |
| 70: mounter | 71: first link |
| 72: second link | 73: guide slot |
| 75: fixer | 77: fixing ring |
| 79: fastening hole | 81: bolt |
| 82: nut | 90: controller |
| 100: roller hemming apparatus | |
| 200: part assembling system | |

DETAILED DESCRIPTION OF THE EMBODIMENTS

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

The drawings and description are to be regarded as illustrative in nature and not restrictive. Like reference numerals designate like elements throughout the specification.

The sizes and thicknesses of elements shown in the drawings are provided selectively for convenience of description, such that the present invention is not limited those shown in the drawings and the thicknesses are exaggerated to make some parts and regions more clear.

In addition, some of elements are called a first, a second, etc., throughout the detailed description in an effort to distinguish such elements from one another because they have the same configurations, but in the following description, such a sequence is not limiting.

In addition, unless explicitly described to the contrary, the word "comprise" and variations such as "comprises" or "comprising" will be understood to imply the inclusion of stated elements but not the exclusion of any other elements.

Further, the terms "-unit", "-means", "-er", and "member" described in the specification mean units for processing at least one function or operation.

FIG. 1 is a schematic diagram of a part assembling system to which a roller hemming apparatus is applied according to an exemplary embodiment of the present invention.

As shown in FIG. 1, a roller hemming apparatus 100 according to an exemplary embodiment of the present invention may be applied to a part assembling system 200 for assembling a part (such as a door assembly, a hood, a trunk, a tailgate, a wheel arch, or a fender) assembled to a vehicle body.

The part may include an outer panel 1 (referring to FIG. 2) and an inner panel 2 (referring to FIG. 2), and the outer panel 1 and the inner panel 2 are assembled by sealer coating and hemming processes.

The part assembling system 200 includes a clamping pad 5, a hemming die 7, and the roller hemming apparatus 100.

The clamping pad 5 is configured to clamp the outer panel 1 and the inner panel 2 loaded on a marriage jig (not shown), and includes clampers (not shown) for clamping the outer panel 1 and the inner panel 2.

The hemming die 7 may be a hemming jig for receiving the outer panel 1 and the inner panel 2 clamped by the clamping pad 5, and is installed on a frame 8.

A clamping pad 5 and a hemming die 7 are well known to a person skilled in the art, and thus a detailed description thereof will be omitted in this specification.

In an exemplary embodiment of the present invention, the roller hemming apparatus 100 is used for hemming an edge portion of the part loaded on the hemming die 7 through roller hemming method. In particular, a flange portion 1*a* of the outer panel 1 is bent toward an edge portion of the inner panel 2 and is pressed by the roller hemming apparatus 100.

Figure 2:
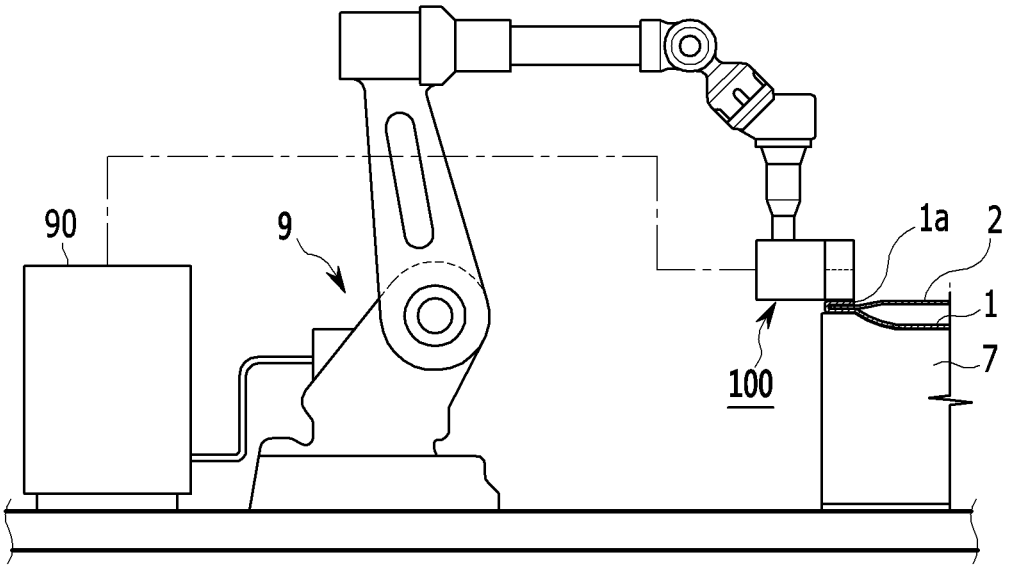
FIG. 2 is a schematic diagram of a roller hemming apparatus according to an exemplary embodiment of the present invention.

FIG. 2 is a schematic diagram of a roller hemming apparatus according to an exemplary embodiment of the present invention.

As shown in FIG. 2, the roller hemming apparatus 100 according to an exemplary embodiment of the present invention is mounted at a front end of an arm of a robot 9 having a predetermined behavior pattern. The robot 9 may be an articulated robot. As the robot 9 is controlled by a controller 90 and is moved along a predetermined route, the roller hemming apparatus 100 moves along edge portions of the outer panel 1 and the inner panel 2 to hem the flange portion 1*a* of the outer panel 1.

In an exemplary embodiment of the present invention, the outer panel 1 hemmed through the roller hemming apparatus 100 may include a high strength portion formed of a high strength material such as magnesium or ultra-high tensile steel.

Hereinafter, an example in which the outer panel 1 and the inner panel 2 are hemmed and assembled using the roller hemming apparatus 100 will be described. However, it should be understood that the scope of the present invention is not limited to the panels, and the technical spirit of the present invention may be applied to various types of panels for various uses.

In an exemplary embodiment of the present invention, the roller hemming apparatus 100 may be configured to soften and hem the high strength portion of the panels by locally heating the high strength portion.

Figure 3:
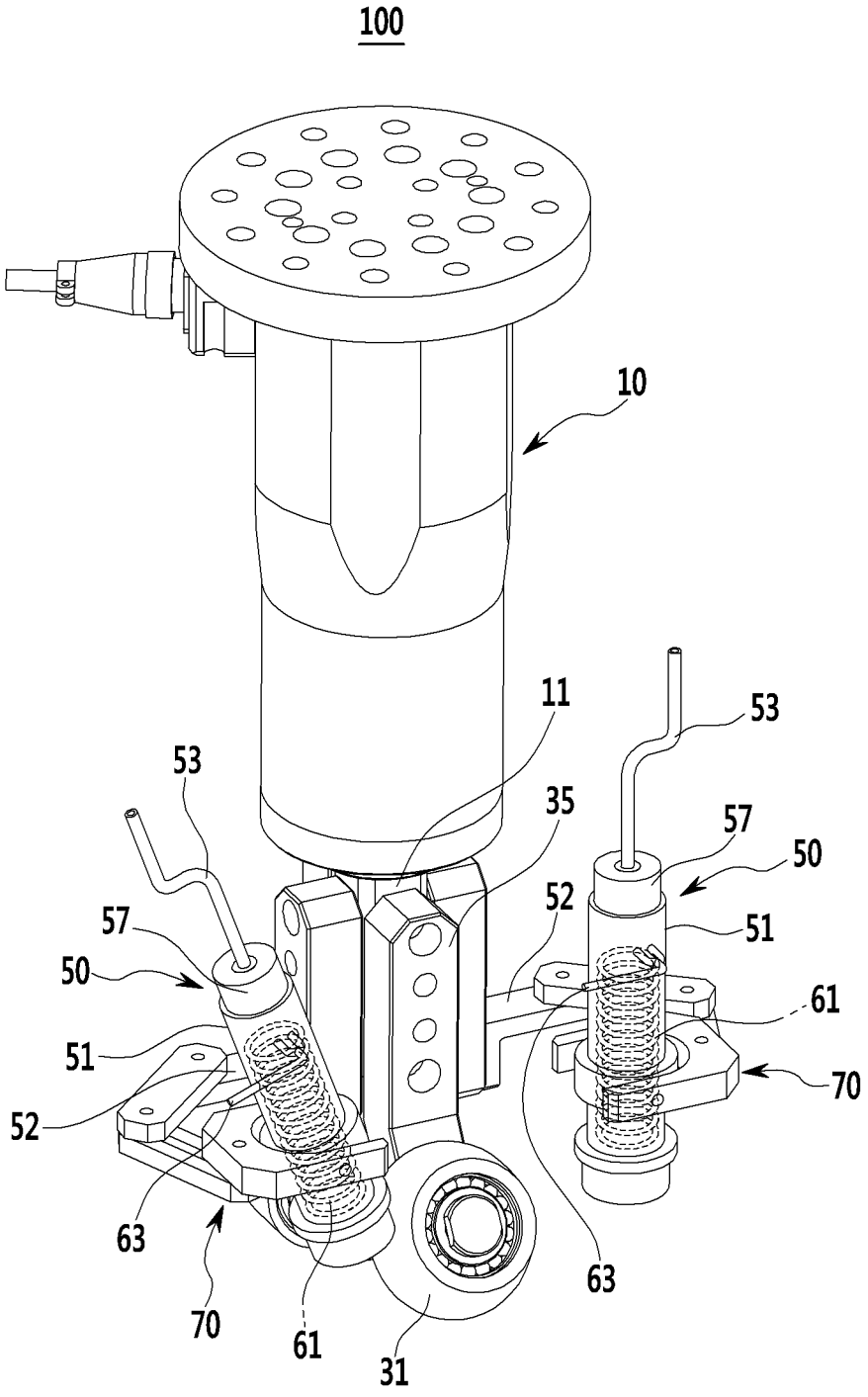
FIG. 3 is a perspective view of a roller hemming apparatus according to an exemplary embodiment of the present invention.
Figure 4:
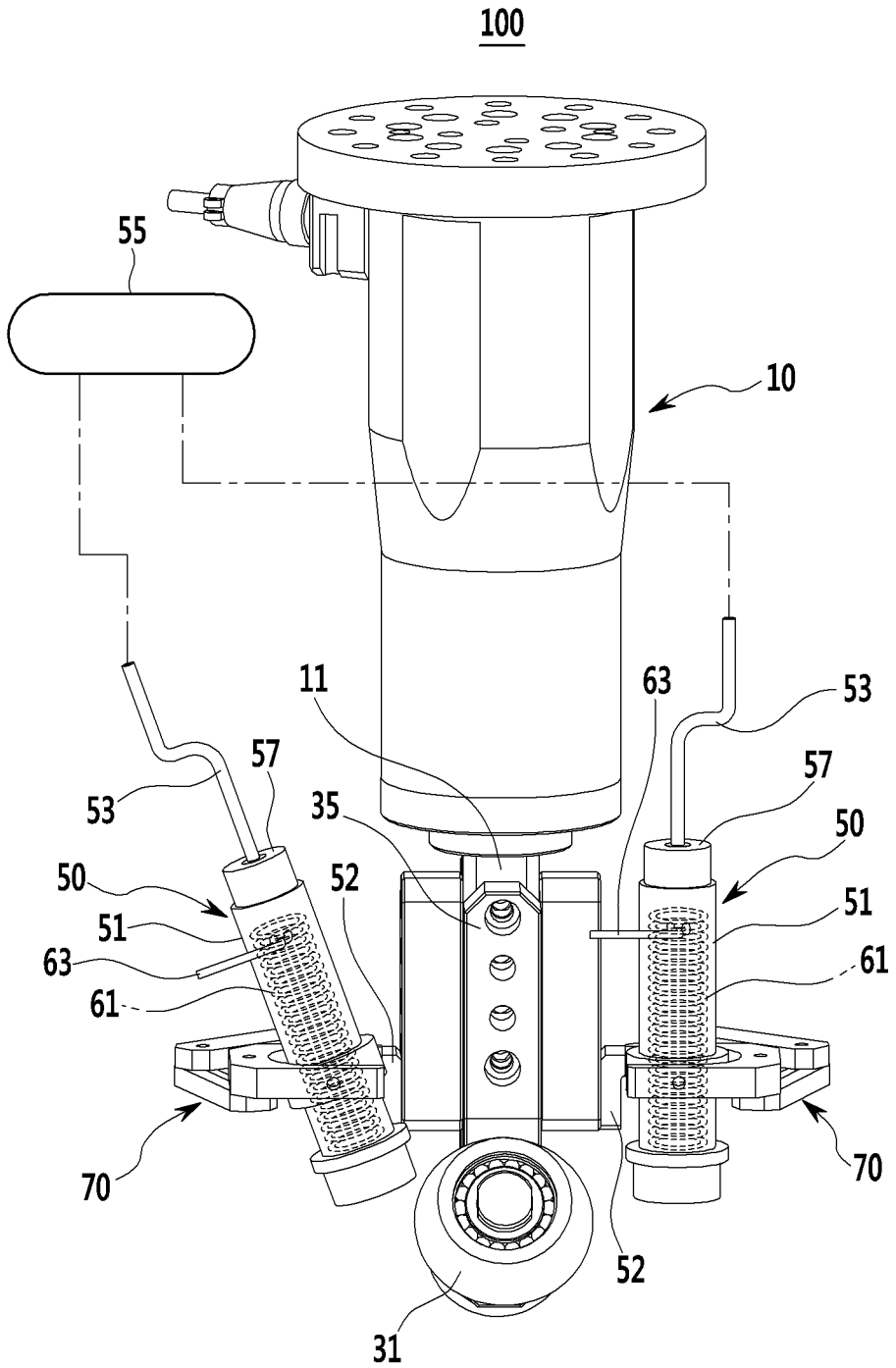
FIG. 4 is a front view of a roller hemming apparatus according to an exemplary embodiment of the present invention.
Figure 5:
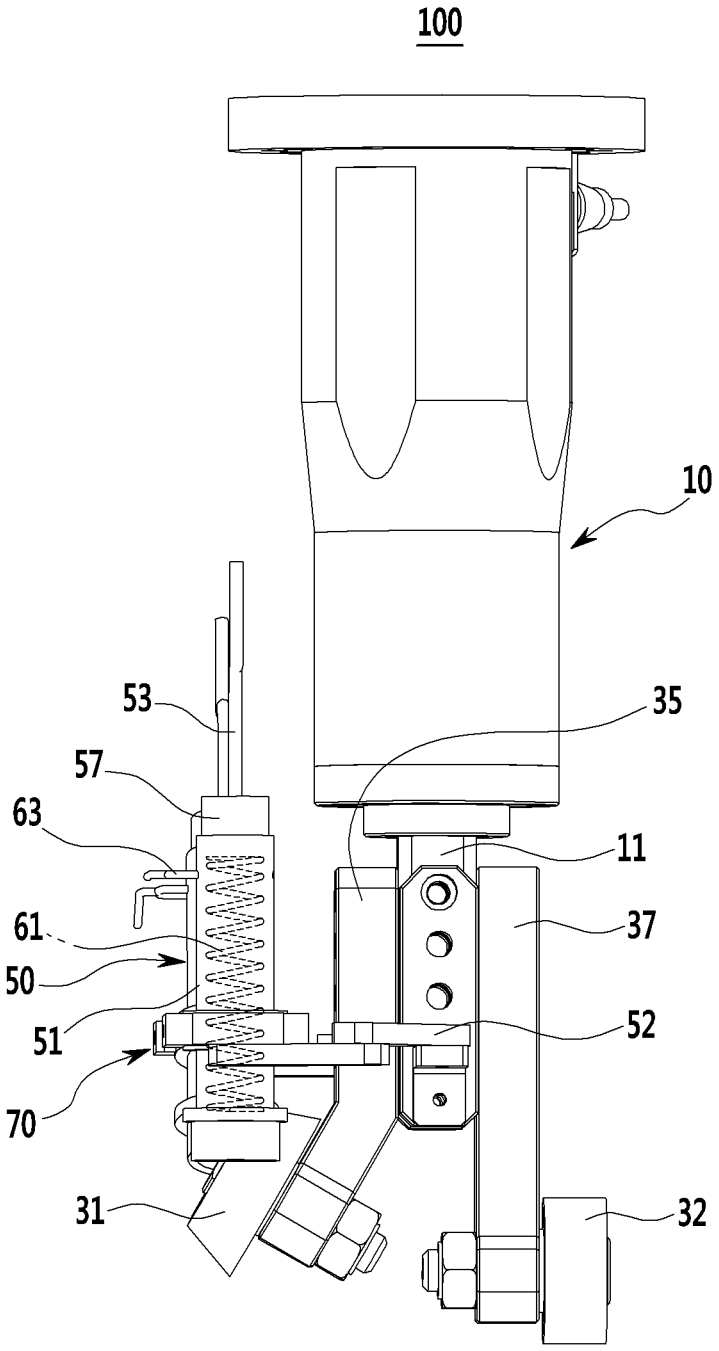
FIG. 5 is a side view of a roller hemming apparatus according to an exemplary embodiment of the present invention.
Figure 6:
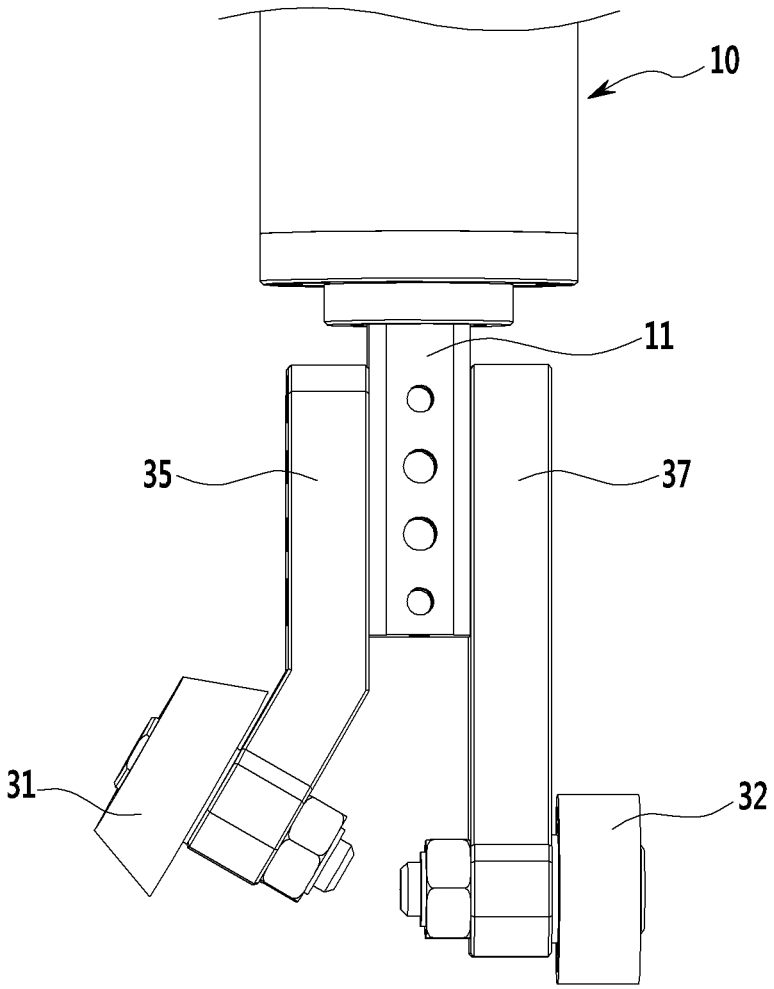
FIG. 6 is a side view of a pre-hemming roller and a main hemming roller applied to a hemming roller apparatus according to an exemplary embodiment of the present invention.
Figure 7:
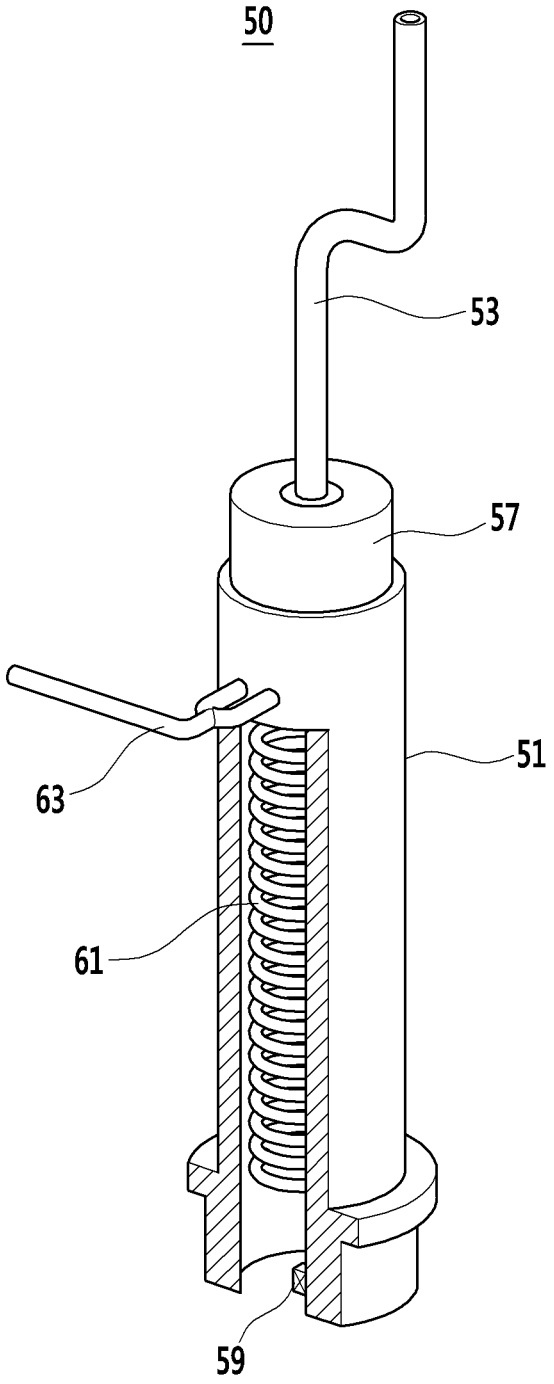
FIG. 7 is a partially cut-away perspective view of a heater applied to a roller hemming apparatus according to an exemplary embodiment of the present invention.

FIG. 3 is a perspective view of a roller hemming apparatus according to an exemplary embodiment of the present invention, FIG. 4 is a front view of a roller hemming apparatus according to an exemplary embodiment of the present invention, FIG. 5 is a side view of a roller hemming apparatus according to an exemplary embodiment of the present invention, FIG. 6 is a side view of a pre-hemming roller and a main hemming roller applied to a hemming roller apparatus according to an exemplary embodiment of the present invention, and FIG. 7 is a partially cut-away perspective view of a heater applied to a roller hemming apparatus according to an exemplary embodiment of the present invention.

As shown in FIG. 3 to FIG. 5, a roller hemming apparatus 100 according to an exemplary embodiment of the present invention may include a tool body 10, hemming rollers 31 and 32, and heaters 50.

The tool body 10 is configured to support constituent elements to be described below, and may be formed into one body or at least two bodies connected to each other.

The tool body 10 may include accessory elements for supporting the constituent elements, such as various kinds of brackets, bars, rods, plates, housings, cases, blocks, rails, collars, etc.

However, because the aforementioned accessory elements are for installation of the respective constituent elements in the tool body 10, except for an exceptional case, the aforementioned accessory elements are generally referred to as the tool body 10 in the exemplary embodiment of the present invention.

The tool body 10 is mounted at the front end of the arm of the robot 9. The robot 9 is teaching-controlled by the controller 90, and the tool body 10 is moved and rotated in multi-axis directions by the robot 9.

The tool body 10 may be releasably mounted at the front end of the arm of the robot 9 through a tool exchanger (not shown).

The hemming rollers 31 and 32 are mounted to a front side and a rear side of a mounting block 11 that is disposed at a lower portion of the tool body 10 based on the figures.

The mounting block 11 may be mounted rotatably clockwise and counter clockwise at the tool body 10. In addition, the mounting block 11 may be mounted at the tool body 10 to be movable in a vertical direction.

Hereinafter, the hemming roller mounted to the front side of the mounting block 11 is referred to as a pre-hemming roller 31, and the hemming roller mounted to the rear side of the mounting block 11 is referred to as a main hemming roller 32 (also referred to as a final hemming roller in this art).

The pre-hemming roller 31 may be configured to pre-hem the flange portion 1*a* of the outer panel 1. For example, the pre-hemming roller 31 primarily pre-hems the flange portion 1*a* such that an angle between the outer panel 1 and the flange portion 1*a* becomes about 80 degrees. After that, the pre-hemming roller 31 secondarily pre-hems the flange portion 1*a* such that the angle between the outer panel 1 and the flange portion 1*a* becomes about 40 degrees. The pre-hemming roller 31 may be formed in a tapered shape having a cross-sectional diameter which is gradually decreased from the rear side to the front side.

The pre-hemming roller 31 is mounted to the front side of the mounting block 11 through a first mounting bracket 35. The lower portion of the first mounting bracket 35 may be bent frontward, and the pre-hemming roller 31 may be rotatably mounted at the lower portion of the first mounting bracket 35.

The main hemming roller 32 finally hems the flange portion 1*a* that is pre-hemmed by the pre-hemming roller 31. For example, the main hemming roller 32 finally hems the flange portion 1*a* such that the angle between the outer panel 1 and the flange portion 1*a* becomes 0 degree.

The main hemming roller 32 is mounted to the rear side of the mounting block 11 through a second mounting bracket 37. The second mounting bracket 37 is fixed to the mounting block 11 in a straight line shape, and the main hemming roller 32 may be rotatably mounted at a lower portion of the second mounting bracket 37.

Hemming angles of the pre-hemming roller 31 and the main hemming roller 32 can be changed according to behavior of the robot 9. In a state that the flange portion 1*a* is pressed by the pre-hemming roller 31 and the main hemming roller 32, the pre-hemming roller 31 and the main hemming roller 32 are moved and rotated along the flange portion 1*a* so as to fold the flange portion 1*a* toward the edge portion of the inner panel 2.

In an exemplary embodiment of the present invention, the heater 50 may be configured to heat the flange portion 1*a* having the high strength portion of the outer panel 1 while the flange portion 1*a* is hemmed.

In detail, the heater 50 blows a hot wind to the flange portion 1*a* of the outer panel 1 while the flange portion 1*a* is hemmed. That is, the heater 50 blows the hot wind to the flange portion 1*a* so as to soften the flange portion 1*a*, thereby reducing the strength thereof.

The heaters 50 are mounted, respectively, at both lateral sides of the mounting block 11 with the pre-hemming roller 31 and the main hemming roller 32 disposed therebetween. The heaters 50 may be mounted at both lateral sides of the mounting block 11 through fixing brackets 52. The fixing brackets 52 are fixedly mounted at both lateral sides of the mounting block 11, respectively.

The heater 50 generates heat by receiving electric power, and is configured to blow the hot wind to the flange portion 1*a* of the outer panel 1. In particular, in an exemplary embodiment of the present invention, the heater 50 can blow the hot wind to the flange portion 1*a* in advance of the pre-hemming roller 31 or the main hemming roller 32 that is moved according to behavior of the robot 9. To this end, the heater 50 may include an air blower pipe 51 and a heating line 61.

The air blower pipe 51 is configured to blow the hot wind to the flange portion 1*a*, and is connected to a compressor 55 through an air supply line 53.

The compressor 55 compresses air and supplies the compressed air to the air blower pipe 51 through the air supply line 53. A cap 57 connected to the air supply line 53 is mounted to an upper portion of the air blower pipe 51. The hot wind is blown through a lower portion of the air blower pipe 51.

An amount of the compressed air supplied from the compressor 55 is controlled by the controller 90.

The heating line 61 is configured to generate heat by receiving electric power, and is mounted in the air blower pipe 51. The heating line 61 may receive electric power through a power supply line 63 and generate heat with electrical resistance.

The heating line 61 may be formed in a coil shape, and disposed in the air blower pipe 51 along a length direction of the air blower pipe 51. An amount of the electric power applied to the heating line 61 is controlled by the controller 90, and a heating temperature of the heating line 61 is adjusted depending on the amount of electric power.

In an exemplary embodiment of the present invention, when the heating line 61 generates heat by receiving the electric power and the compressed air is supplied to the air blower pipe 51, the hot wind at a predetermined temperature is blown to the flange portion 1*a* through the air blower pipe 51.

In addition, in an exemplary embodiment of the present invention, a temperature sensor 59, which measures a temperature of the hot wind and transmits a signal corresponding thereto to the controller 90, may be mounted in the lower portion of the air blower pipe 51.

For example, the temperature sensor 59 may transmit the measured temperature of the hot wind blown through the air blower pipe 51 to the controller 90.

The controller 90 may control the amount of the electric power applied to the heating line 61 and the amount of the compressed air supplied from the compressor 55 based on the measured temperature.

Since the strength of the flange portion 1*a* is inversely proportional to a temperature thereof, the controller 90 may calculate an estimated strength of the flange portion 1*a* based on the measured temperature.

As a result, the controller 90 may control the amount of the electric power applied to the heating line 61 and the amount of the compressed air supplied from the compressor 55 by comparing the estimated strength of the flange portion 1*a* and a reference strength.

The reference strength may be set by a person of ordinary skill in the art in consideration of an actual strength of the flange portion 1*a* for easily hemming the flange portion 1*a*.

When the estimated strength of the flange portion 1*a* is greater than or equal to the reference strength, the controller 90 increases the amount of the electric power applied to the heating line 61 and the amount of the compressed air supplied from the compressor 55.

When the estimated strength of the flange portion 1*a* is less than the reference strength, the controller 90 decreases the amount of the electric power applied to the heating line 61 and the amount of the compressed air supplied from the compressor 55.

Herein, it is described that the heater 50 includes the heating line 61 and the air blower pipe 51, but it is should be understood that the scope of the present invention is not limited thereto.

In accordance with another exemplary embodiment, the heater 50 may be configured such that high frequency radiant heat or laser beams are irradiated to the flange portion 1*a*.

Figure 8:
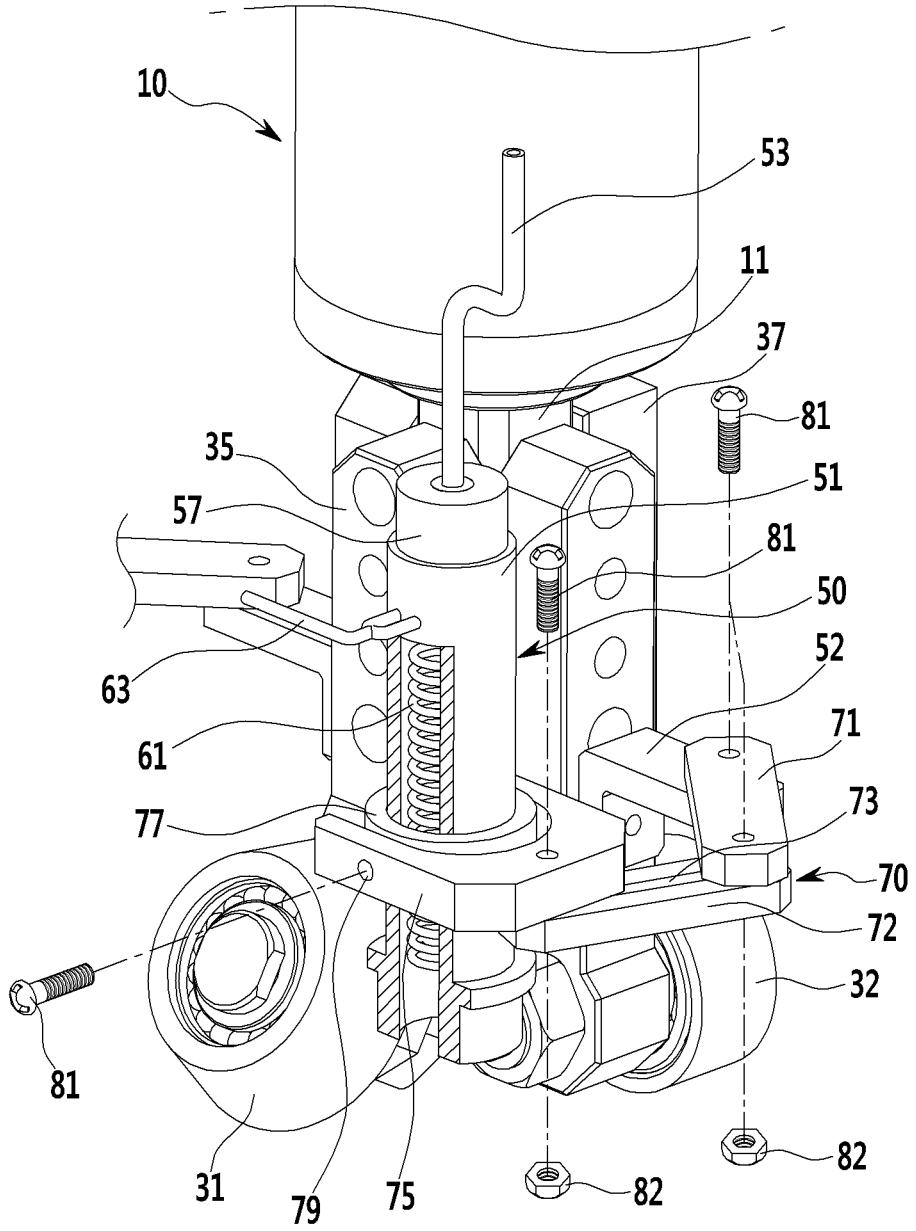
FIG. 8 is a perspective view of a mounter applied to a roller hemming apparatus according to an exemplary embodiment of the present invention.

FIG. 8 is a perspective view of a mounter applied to a roller hemming apparatus according to an exemplary embodiment of the present invention.

In an exemplary embodiment of the present invention, the heater 50 may be provided to be tilted in a progression direction of the pre-hemming roller 31 and the main hemming roller 32, and a position of the heater 50 may be changed with respect to the fixing bracket 52.

To this end, the roller hemming apparatus 100 according to an exemplary embodiment of the present invention may further include a mounter 70 that mounts the heater 50 through the fixing bracket 52. The mounter 70 is configured to tilt the heater 50 and change the position of the heater 50.

In detail, the mounter 70 may tilt the lower portion of the heater 50 toward the hemming rollers 31 and 32. In addition, the mounter 70 may change the position of the heater 50 with respect to the hemming rollers 31 and 32, and fixes the heater 50. That is, the mounter 70 may move the heater 50 in forward and backward directions and fix the heater 50 at the moved position.

The mounter 70 according to an exemplary embodiment of the present invention may include a first link 71, a second link 72, and a fixer 75.

The first link 71 is coupled to the fixing bracket 52 that is fixedly mounted at the lateral side of the mounting block 11. One end portion of the first link 71 may be coupled to the fixing bracket 52 using a bolt 81 and a nut 82.

The second link 72 is coupled to the first link 71. One end portion of the second link 72 may be coupled to the other end portion of the first link 71 using a bolt 81 and a nut 82.

A guide slot 73 may be formed in the second link 72 in a length direction. In this case, the other end portion of the first link 71 is coupled to the guide slot 73 formed at the one end portion of the second link 72 using the bolt 81 and the nut 82.

The fixer 75 is configured to fix the air blower pipe 51 of the heater 50, and is coupled to the other end portion of the second link 72. The fixer 75 may be coupled to the guide slot 73 formed at the other end portion of the second link 72 using a bolt 81 and a nut 82.

The fixer 75 may be formed in a "C" shape for surrounding an external circumference of the air blower pipe 51. The shape of the fixer 75 is not limited thereto, and may be variously modified. For example, the fixer 75 may be formed in a "D" shape or an "O" shape. The fixer 75 may fix the air blower pipe 51 through a fixing ring 77.

The fixing ring 77 may be fitted to the external circumference of the air blower pipe 51 and be coupled to the fixer 75. Both lateral sides of the fixing ring 77 may be coupled to both lateral sides of the fixer 75 using bolts 81.

In detail, holes (not shown) corresponding to both lateral sides of the fixer 75 are formed at both lateral sides of the fixing ring 77, and fastening holes 79 corresponding to the holes of the fixing ring 77 are formed at the both lateral sides of the fixer 75.

The fixing ring 77 is coupled to the fixer 75 by fastening the bolt 81 while being fitted to the external circumference of the air blower pipe 51, and thus the air blower pipe 51 is fixed to the fixer 75 through the fixing ring 77.

By adjusting tightness of the bolt 81, the lower portion of the air blower pipe 51 may be tilted toward the hemming rollers 31 and 32 using the bolt 81 as a shaft.

An operation of the roller hemming apparatus 100 according to an exemplary embodiment of the present invention will hereinafter be described in detail with reference to FIG. 1 to FIG. 10.

Figure 9:
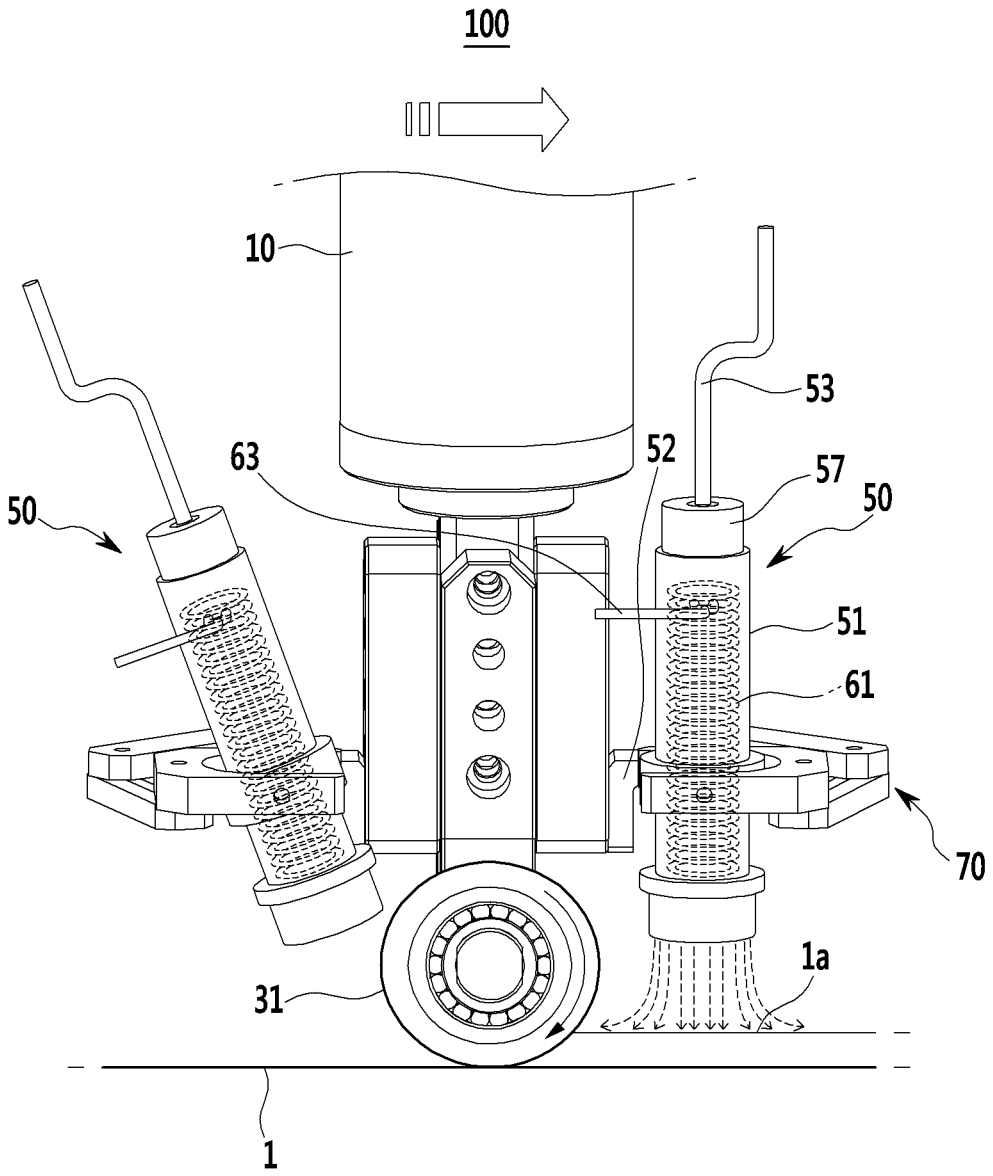
FIGS. 9 and 10 are views illustrating an operation of a roller hemming apparatus according an exemplary embodiment of the present invention.
Figure 10:
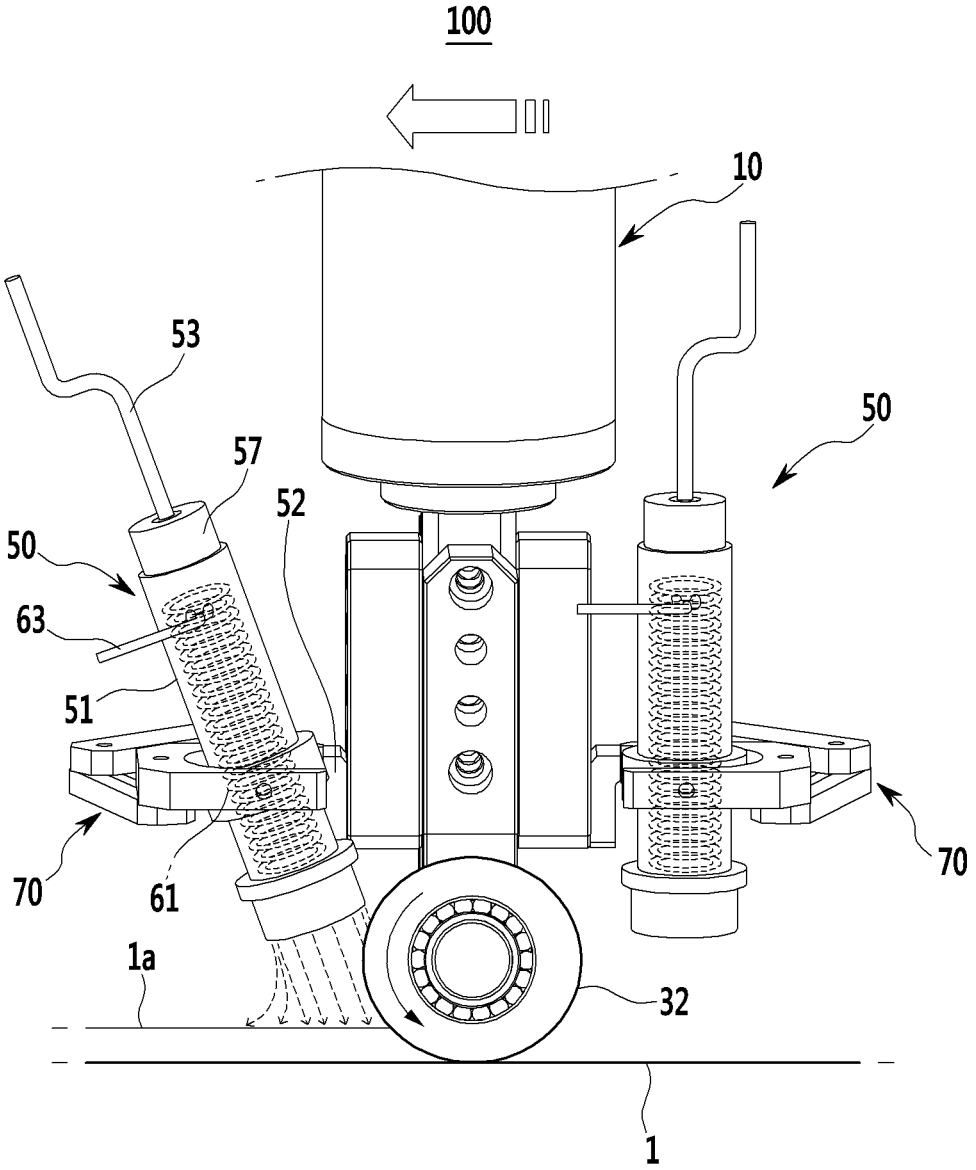

FIGS. 9 and 10 are views illustrating an operation of a roller hemming apparatus according to an exemplary embodiment of the present invention.

First, the clamping pad 5 of the part assembling system 200 clamps the outer panel 1 and the inner panel 2 loaded on the marriage jig, and the outer panel 1 and the inner panel 2 are installed on the hemming die 7.

The roller hemming apparatus 100 is moved toward edge portions of the outer panel 1 and the inner panel by the robot 9.

As the roller hemming apparatus 100 is moved along the predetermined route by the robot 9, the pre-hemming roller 31 and the main hemming roller 32 move along edge portions of the outer panel 1 and the inner panel 2 to hem the flange portion 1*a* of the outer panel 1.

In detail, the pre-hemming roller 31 primarily pre-hems the flange portion 1*a* such that the angle between the outer panel 1 and the flange portion 1*a* becomes about 80 degrees. After that, the pre-hemming roller 31 secondarily pre-hems the flange portion 1*a* such that the angle between the outer panel 1 and the flange portion 1*a* becomes about 40 degrees.

The main hemming roller 32 finally hems the flange portion 1*a* that is pre-hemmed by the pre-hemming roller 31 such that the angle between the outer panel 1 and the flange portion 1*a* becomes 0 degree.

Herein, hemming angles of the pre-hemming roller 31 and the main hemming roller 32 can be changed according to the behavior of the robot 9. Further, in a state that the flange portion 1*a* is pressed by the pre-hemming roller 31 and the main hemming roller 32, the pre-hemming roller 31 and the main hemming roller 32 are moved and rotated along the flange portion 1*a* so as to fold the flange portion 1*a* toward the edge portion of the inner panel 2.

As shown in FIGS. 9 and 10, the heater 50 blows the hot wind to the flange portion 1*a* to soften the flange portion 1*a* while the flange portion 1*a* is hemmed, thereby reducing the strength of the flange portion 1*a*.

When the heating line 61 of the heater 50 generates heat by receiving electric power and the compressed air is supplied to the air blower pipe 51 from the compressor 55, the hot wind at the predetermined temperature is blown to the flange portion 1*a* of the outer panel 1.

The heater 50 can blow the hot wind to the flange portion 1*a* of the outer panel 1 in advance of the pre-hemming roller 31 or the main hemming roller 32 that is moved according to behavior of the robot 9.

The heater 50 adjusts a blow angle of the hot wind through the mounter 70.

By adjusting the tightness of the bolt 81 fastening the fixing ring 77 to the fixer 75, the lower portion of the air blower pipe 51 is tilted toward the hemming rollers 31 and 32 using the bolt 81 as the shaft.

In addition, the mounter 70 changes the position of the heater 50 with respect to the hemming rollers 31 and 32, and fixes the heater 50.

The mounter 70 moves the heater 50 in forward and backward directions and fixes the heater 50 at the moved position.

As the bolt 81 coupling the first link 71 and the second link 72, and the bolt 81 coupling the second link 72 and the fixer 75 are loosened and fastened, the fixer 75 can be moved and fixed at the moved position.

In an exemplary embodiment of the present invention, the temperature sensor 59 measures the temperature of the hot wind and transmits the measured temperature of the hot wind to the controller 90 while the hot wind is blown to the flange portion 1*a* through the air blower pipe 51.

The controller 90 calculates the estimated strength of the flange portion 1*a* based on the measured temperature. When the estimated strength of the flange portion 1*a* is greater than or equal to the reference strength, the controller 90 increases the amount of the electric power applied to the heating line 61 and the amount of the compressed air supplied from the compressor 55.

When the estimated strength of the flange portion 1*a* is less than the reference strength, the controller 90 decreases the amount of the electric power applied to the heating line 61 and the amount of the compressed air supplied from the compressor 55.

As described above, the roller hemming apparatus 100 according to an exemplary embodiment of the present invention can blow the hot wind to the high strength portion of the panels through the heater 50.

The flange portion 1*a* is softened by the hot wind while the flange portion 1*a* is hemmed.

As a result, spring back and cracks can be prevented from being generated in the flange portion 1*a* by heating the flange portion 1*a*.

Further it is possible to suppress occurrence of hemming defects such as insufficiency of a bend degree of the flange portion 1*a*, thereby improving quality of the hemmed part.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A roller hemming apparatus for hemming an outer panel having a flange portion with respect to an inner panel using an arm of a robot which has a front end, the roller hemming apparatus comprising:

a tool body mounted at the front end of the arm of the robot and having a lower portion;

a mounting block disposed at the lower portion of the tool body and having a first side, a second side and a third side;

a pre-hemming roller mounted to the first side of the mounting block;

a first mounting bracket mounting the pre-hemming roller to the first side of the mounting block;

a main hemming roller mounted to the second side of the mounting block;

a second mounting bracket mounting the main hemming roller mounted to the second side of the mounting block; and at least one heater mounted at the third side of the mounting block and configured to heat the flange portion of the outer panel, wherein the heater generates heat by receiving electric power and blow a hot wind to the flange portion of the outer panel.

2. The roller hemming apparatus of claim 1, wherein the pre-hemming roller is formed in a tapered shape having a cross-sectional diameter which is gradually decreased from a rear side to a front side.

3. The roller hemming apparatus of claim 1, wherein the heater is mounted through a fixing bracket that is fixedly mounted at the third side of the mounting block, and configured to be tilted toward the pre-hemming roller and the main hemming roller.

4. The roller hemming apparatus of claim 1, wherein a lower portion of the first mounting bracket is bent away from the first side of the mounting block and the pre-hemming roller is rotatably mounted at the lower portion of the first mounting bracket.

5. The roller hemming apparatus of claim 1, wherein the heater comprises:

an air blower pipe connected to a compressor through an air supply line; and a heating line mounted in the air blower pipe and configured to generate heat by receiving electric power.

6. The roller hemming apparatus of claim 5, wherein the heating line is formed in a coil shape and disposed along a length direction of the air blower pipe.

7. The roller hemming apparatus of claim 5, wherein a temperature sensor, which measures a temperature of the heat and transmits a signal corresponding thereto to a controller, is mounted in a lower portion of the air blower pipe.

8. The roller hemming apparatus of claim 7, wherein the controller controls an amount of the electric power applied to the heating line and an amount of compressed air supplied from a compressor based on the measured temperature.

9. A roller hemming apparatus for hemming an outer panel having a flange portion with respect to an inner panel using an arm of a robot which has a front end, the roller hemming apparatus comprising:

a tool body mounted at the front end of the arm of the robot and having a lower portion;

a mounting block disposed at the lower portion of the tool body and having a first side, a second side and a third side;

a pre-hemming roller mounted to the first side of the mounting block;

a first mounting bracket mounting the pre-hemming roller to the first side of the mounting block;

a main hemming roller mounted to the second side of the mounting block;

a second mounting bracket mounting the main hemming roller mounted to the second side of the mounting block;

at least one heater mounted at the third side of the mounting block and configured to heat the flange portion of the outer panel; and a mounter configured to mount the heater through a fixing bracket that is fixedly mounted at the third side of the mounting block and change a position of the heater, wherein the heater comprises an air blower pipe connected to a compressor through an air supply line and a heating line mounted in the air blower pipe to generate heat by receiving electric power.

10. The roller hemming apparatus of claim 9, wherein a cap connected to the air supply line is mounted to an upper portion of the air blower pipe, and a hot wind is blown through a lower portion of the air blower pipe.

11. The roller hemming apparatus of claim 10, wherein a temperature sensor, which measures a temperature of the hot wind and transmits a signal corresponding thereto to a controller, is mounted in the lower portion of the air blower pipe.

12. The roller hemming apparatus of claim 9, wherein the heating line is formed in a coil shape and disposed along a length direction of the air blower pipe.

13. The roller hemming apparatus of claim 9, wherein the mounter comprises:

a first link coupled to the fixing bracket;

a second link coupled to the first link; and a fixer coupled to the second link and configured to fix the air blower pipe.

14. The roller hemming apparatus of claim 13, wherein the fixer is formed for surrounding an external circumference of the air blower pipe, and the air blower pipe is fixed through a fixing ring.

15. The roller hemming apparatus of claim 14, wherein the fixing ring is fitted to the external circumference of the air blower pipe and is coupled to the fixer using a bolt.

16. The roller hemming apparatus of claim 15, wherein the lower portion of the air blower pipe is tilted toward the pre-hemming roller and the main hemming roller using the bolt as a shaft.

17. The roller hemming apparatus of claim 13, wherein a guide slot is formed in the second link in a length direction.

18. The roller hemming apparatus of claim 17, wherein the pre-hemming roller is formed in a tapered shape having a cross-sectional diameter which is gradually decreased from a rear side to a front side, a lower portion of the first mounting bracket is bent away from the first side of the mounting block, and the pre-hemming roller is rotatably mounted at the lower portion of the first mounting bracket.

* * * * *